US005771473A

United States Patent [19]

Yu et al.

[11] Patent Number: 5,771,473

[45] Date of Patent: Jun. 23, 1998

[54] METHOD AND PLANT FOR CLEANING LIGHTLY RADIOACTIVE WASTE INCINERATION GASES

[75] Inventors: Dehui Yu, Levallois-Perret; Dominique Touchais, Saint-Remy-les-Chevreuses, both of France

[73] Assignee: Service Protection Environnement Ingenierie et Construction "SPEIC", France

[21] Appl. No.: 716,157

[22] PCT Filed: Mar. 14, 1995

[86] PCT No.: PCT/FR95/00300

§ 371 Date: Sep. 13, 1996

§ 102(e) Date: Sep. 13, 1996

[87] PCT Pub. No.: WO95/25332

PCT Pub. Date: Sep. 21, 1995

[30] Foreign Application Priority Data

Mar. 14, 1994 [FR] France ..... 94 02924

[51] Int. Cl.[6] ..... G21F 9/00

[52] U.S. Cl. ..... 588/18; 110/345; 422/120; 422/159

[58] Field of Search ..... 588/18, 19; 110/237, 110/345, 346; 422/120, 159

[56] References Cited

U.S. PATENT DOCUMENTS 4,482,479 11/1984 Kamiya et al. .

4,666,490 5/1987 Drake ..... 65/27

FOREIGN PATENT DOCUMENTS

A-2 408 196 11/1978 France ..... G21F 9/00

A-36 39 289 11/1986 Germany ..... G21F 9/02

OTHER PUBLICATIONS

Patent Abstracts of Japan, vol. 13, No. 269, Jun. 21, 1989.

*Primary Examiner*—Ngoclan Mai

*Attorney, Agent, or Firm*—Blakely Sokoloff Taylor & Zafman

[57] ABSTRACT

Plant for cleaning gases (1) from an incinerator (3) of lightly radioactive waste. The plant includes a cooler-condenser (6, 100) for cooling gases (1) to a temperature lower than the dew point, a heater (300) for raising the temperature of the gases as they are discharged from the cooler-condenser (6, 100), a filter (200) for recovering solid particles downstream of the heater before the gases are discharged into the atmosphere, a unit (3) for treating condensates, and capable of precipitating radioactive heavy metals for recovery of a radioactive precipitate and an aqueous solution, an a unit (36) for crystallizing salts and concentrating them to dryness in an aqueous solution and recovering water to be recycled in the plant (2).

10 Claims, 3 Drawing Sheets

METHOD AND PLANT FOR CLEANING LIGHTLY RADIOACTIVE WASTE INCINERATION GASES

The present invention concerns the cleaning of gases produced by the incineration of lightly radioactive waste, especially although not exclusively the treatment of gases from an incinerator for melting and vitrifying waste, such as waste generated by the nuclear industry, hospitals and universities.

The incineration of lightly radioactive waste produces gases containing water vapor, acid pollutants such as hydrogen halogenides, solid particles, some of which are soluble, and radioactive heavy metals, all of which must be extracted from the gases before they are returned to the atmosphere.

One treatment of these gases known in itself entails cooling them by means of a heat recovery device to a temperature compatible with passing them through a filter adapted to retain the solid particles and then treating the gases from which the dust has been removed in a gas scrubbing plant to remove the acid pollutants and some of the gaseous heavy metals, before the gases are returned to the atmosphere. The gases from incinerators for melting and vitrifying waste are at a high temperature, up to 1 250° C., and the heat recovery device must be especially designed and constructed from heat and corrosion resistant materials which are costly. To overcome this drawback it has been proposed to cool the gases by diluting them with air but this solution has the disadvantage of increasing the quantity of gases to be treated. Moreover, cooling the gases before they are sent to the filters causes adsorption of the radioactive heavy metals on the solid particles calling for special precautions in packaging and handling them when they have been extracted from the gases. The prior art plants thus produce a large volume of radioactive solid residues that are costly to handle and store. Moreover, the solid particles that have adsorbed the radioactive heavy metal particles contaminate all of the plant on the outlet side of the filter, and the gaseous radioactive heavy metals contaminate the gas scrubbing equipment, and when these plant items are replaced they are radioactive, calling for particular precautions in dismantling, transportation and disposal.

Publication FR-A-2 408 196 describes a waste treatment process that includes, among other steps, a step of cooling and condensing particles contained in these gases, the wet particles being separated by passing through a screen after which the gases are heated and filtered.

The present invention is intended to reduce the cost of treating the gases and to improve the performance of the gas treatment by reducing the residual levels of pollutants in the cleaned gases, and achieves this aim through a plant characterized in that it includes:

a cooler-condenser adapted to cool the gases before filtration or collection of the solid particles to a temperature below their dew point temperature to capture the radioactive heavy metals in the condensates at the same time as the acid pollutants and soluble solid particles contained in the gases, a unit for treating the condensates to precipitate the radioactive heavy metals to recover a radioactive precipitate and an aqueous solution, a salt crystallization unit for crystallizing salts contained in said aqueous solution and to recover water to be recycled in the plant, a heater for increasing the temperature of the gases on leaving the cooler-condenser, and an absolute filter for recovering the solid particles on the outlet side of the heater before the cleaned gases are returned to the atmosphere.

The solid particles conveyed by the gases are recovered by the filter after the radioactive heavy metals have been removed from the gases and are therefore not radioactive or only slightly radioactive, requiring no special precautions for handling them, and can be passed to the incinerator to be melted and vitrified. Crystallization of the treated neutralized condensate salts eliminates liquid waste and produces salts that can be used industrially and water that can be recycled into the gas circuit. The final waste resulting form the treatment of the gases is therefore limited to the precipitate, and the handling and storage of this final waste is therefore facilitated compared to prior art plants which produce a greater quantity of waste. Moreover, the number of equipments contaminated by the gases is reduced compared to prior art plant since the radioactive heavy metals are eliminated in the cooler-condenser, i.e. in the first step of the treatment.

The invention therefore consists in a method of cleaning gases from an incinerator of lightly radioactive waste, said gases containing water vapor, acid pollutants, solid particles and radioactive heavy metals, the method including a step of cooling the gases and a step of filtering the gases, characterized in that the gases are cooled before filtration or collection of the solid particles in a cooler-condenser below their dew point temperature to capture the radioactive heavy metals in the condensates at the same time as the acid pollutants and soluble particles contained in the gases, in that the condensates are treated to precipitate the radioactive heavy metals and to recover an aqueous solution that is directed to a crystallization unit in order to recover salts and water, and in that the gases from the cooler-condenser are heated and then directed to an absolute filter adapted to recover the solid particles before the cleaned gases are returned to the atmosphere, the water from said crystallization unit being recycled in the plant.

In one embodiment of the invention the gases are cooled by contact with an aqueous solution sprayed into a cooling enclosure to a temperature near their dew point temperature and then by contact with a condensation heat exchanger to a temperature below their dew point temperature.

In an alternative embodiment the gases are cooled by contact with a aqueous solution sprayed into a cooling enclosure to a temperature near their dew point temperature and then by direct contact of the gases with an aqueous solution sprayed into a scrubbing column and maintained by a heat exchanger at a temperature below said dew point temperature of the gases, with the result that the heavy metals are extracted from the gases by condensation by mixing at the same time as acid pollutants and soluble particles contained in the gases are captured.

BRIEF DESCRIPTION OF THE DRAWINGS

Other features and advantages of the present invention will emerge from a reading of the following detailed description of non-limiting embodiments of the invention and an examination of the accompanying drawings, in which.

Figure 1:
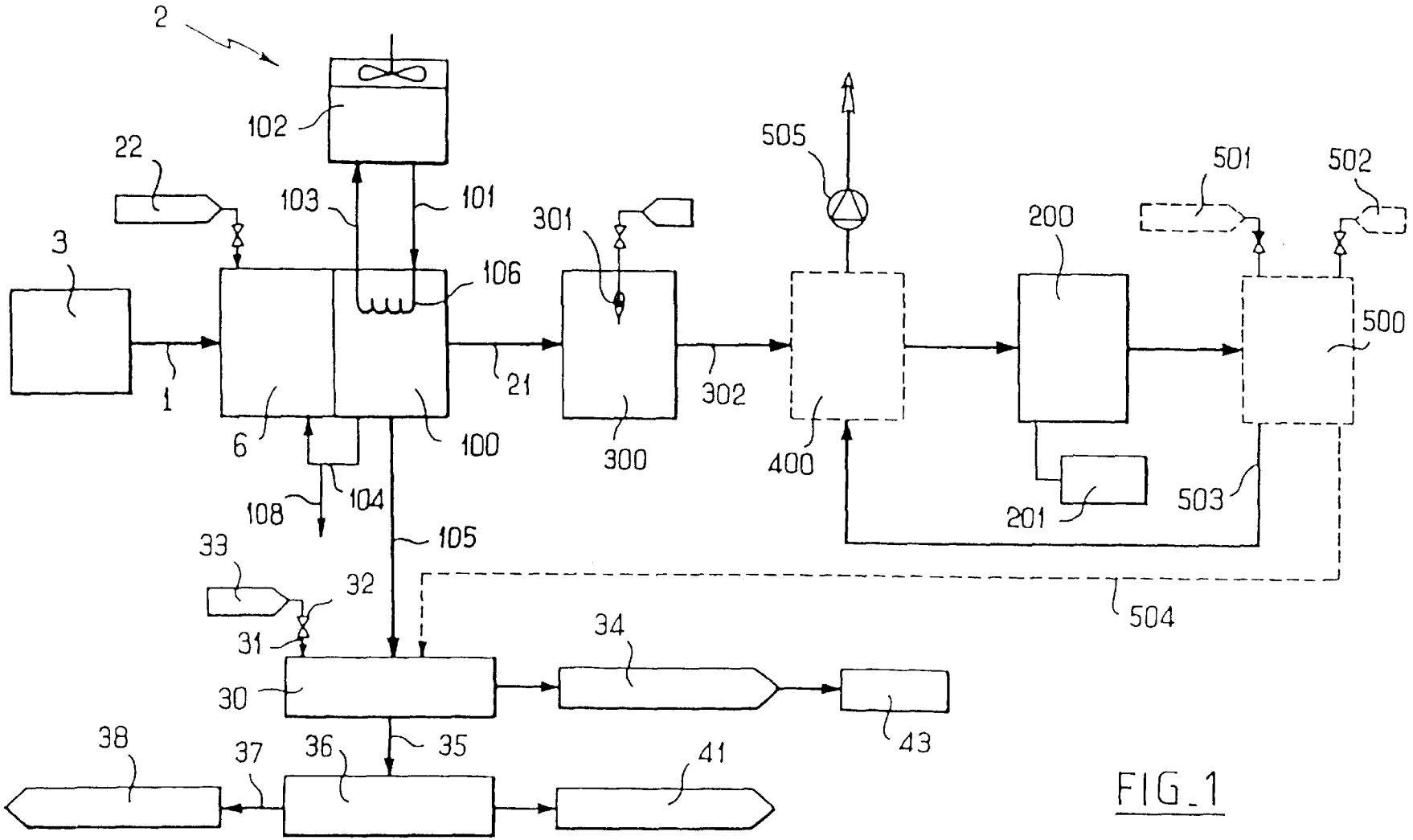
FIG. 1 is a general block diagram of a first embodiment of cleaning plant of the invention equipped with a surface type condenser.

The plant shown in FIG. 1 is for treating a flow 1 of gases from an incinerator 3 of lightly radioactive waste, for example waste generated by the nuclear industry, hospitals and universities. The incinerator 3 is preferably of the type including a ladle in which waste is melted by a plasma torch or an electroburner in order to vitrify it. The gases to be treated carry solid particles and radioactive heavy metals. They contain water vapor formed during the combustion of the waste and acid pollutants such as hydrogen halogenides and organic pollutants. The temperature of the gases is high, up to 1 250° C.

The flow 1 of gases is directed into a cooler-condenser including a cooling enclosure 6 into which an aqueous solution is sprayed to cool the gases quickly to a temperature near their dew point temperature. On leaving the cooling enclosure 6 the gases are directed into a condenser 100 in which they are cooled to a temperature below their dew point temperature, with the result that the radioactive heavy metals are extracted from the gases when the water vapor contained in them condenses, at the same time as the acid pollutants and soluble solid particles carried by the gases are captured.

In the FIG. 1 embodiment, the condenser 100 is a surface type condenser including a heat exchanger 106 adapted to exchange heat between the gases and a coolant leaving at 101 a cooling unit 102 to feed the exchanger 106 at a temperature below the dew point temperature and then returning at 103 to the cooling unit 102. The condensation products that form in contact with the exchanger 106 are directed through a circuit 104 into the cooling enclosure 6 where they are in contact with the gases passing through the latter, to reduce their temperature suddenly, i.e. to quench them, to a temperature near their dew point temperature. During this quenching the heavy metals are not adsorbed onto the solid particles carried by the gases. The circuit 104 advantageously includes a clarifier for recovering at 108 solid particles that are preferably directed into the incinerator to be melted and vitrified.

A purge circuit 105 is provided for drawing off the condensation products when the concentration of radioactive heavy metals or other pollutants is high, to direct them to a treatment unit 30 receiving at 31 through a valve 32 reagents 33, for example soda, flocculating agents and insolubilizing agents, in order to precipitate the radioactive heavy metals. The precipitate is extracted by filtration to recover irradiated filter cakes at 34. The aqueous solution from which the precipitate has been removed contains salts formed during neutralization of the acid pollutants and soluble particles dissolved in the condensates. This aqueous solution is directed at 35 into a salt crystallization unit 36 from which water is recovered at 37 and directed into a distribution network 38 for recycling in the plant 2. Crystallized salts 41 that can be used industrially are also recovered. The filter cakes 34 are packaged for storage at 43. The crystallization unit advantageously has two stages, the first comprising a forced circulation concentrator and the second an evaporator-crystallizer.

The cleaned gases leaving the condenser 100 pass through a heater 300, in the example described here a heater including a propane burner 301, to heat them to a temperature such that the solid particles they carry are dry and to absorb the water produced upon crystallization of the salts, which is fed back into the enclosure 6 through a feed 22 connected to the network 38; accordingly, the plant 2 does not produce any liquid effluent.

On leaving the heater 300 the gases are advantageously passed through a heat exchanger 400 and are then directed into a filter 200. The heat exchanger 400 is adapted to exchange heat between the hot gases leaving the heater 300 at 302 and the cleaned gases that have passed through the filter 200, before the latter are returned to the atmosphere. The heat exchanger 400 prevents temperature fluctuations that could damage the filter 200 on the outlet side of the heater 300 and prevents the formation of a white plume when the cleaned gases are returned to the atmosphere via a chimney.

The filter 200 adapted to retain the solid particles carried in the gases is an absolute filter, for example a very high efficiency two-stage filter. The solid particles, which are virtually free of radioactive heavy metals, retained by the filter 200 are recovered at 201 and are advantageously directed into the incinerator 3 to be melted and vitrified. Because of the heater 300, the solid particles reaching the filter 200 are no longer wet, which avoids clogging of the filter. On leaving the filter 200, the cleaned gases are preferably directed into a desulphurization unit 500 receiving at 501 recycled water from the distribution network 38 and at 502 basic additives, for example soda, in a manner that is known in itself, to form a basic scrubbing solution. The cleaned gases leave the desulphurization unit 500 at 503 on their way to the exchanger 400 and are returned to the atmosphere by a fan 505 after passing through the exchanger; a purge for deconcentrating the basic scrubbing solution is directed to the treatment unit 30 at 504.

Figure 2:
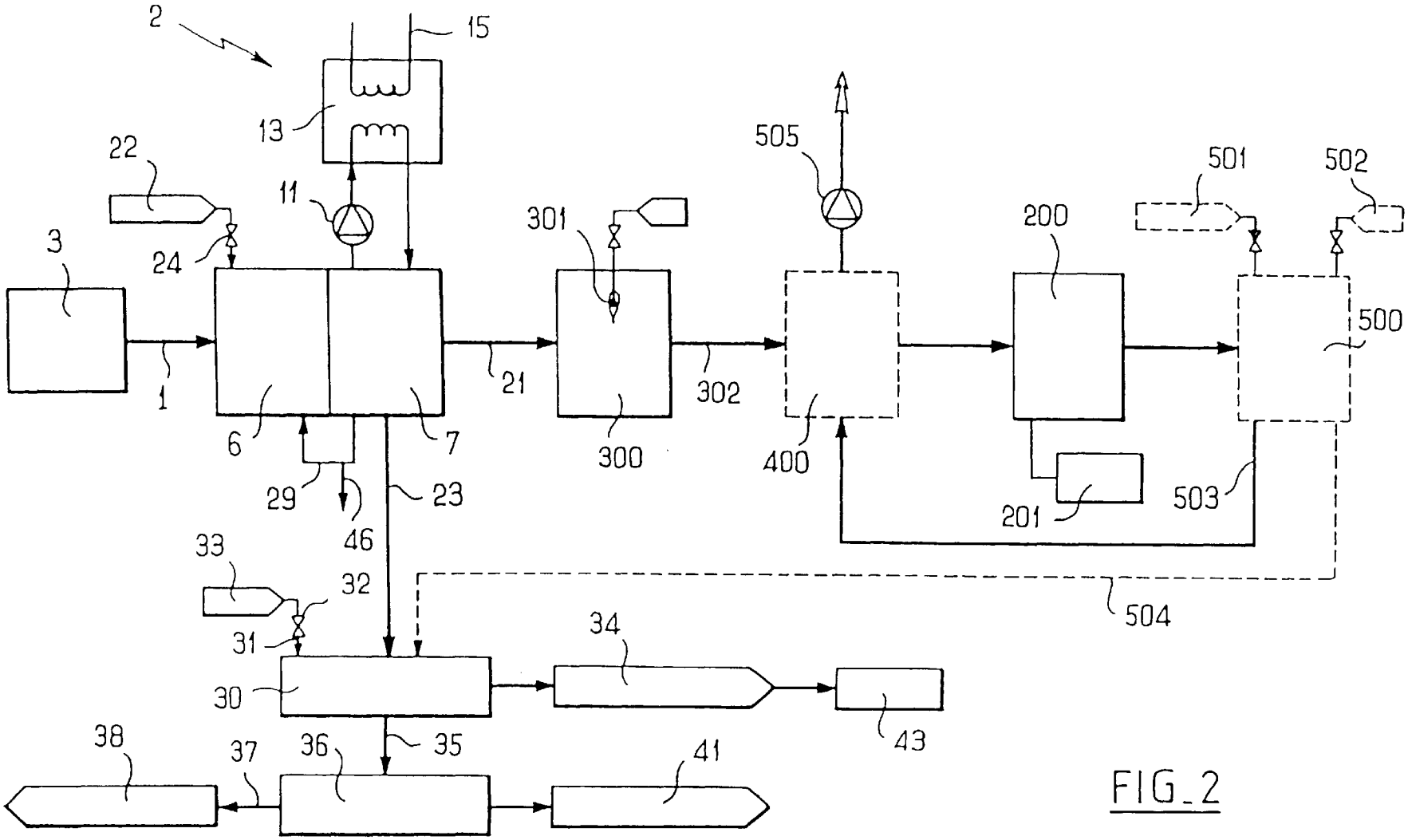
FIG. 2 is a general block diagram of a second embodiment of cleaning plant of the invention equipped with a mixing type condenser.
Figure 3:
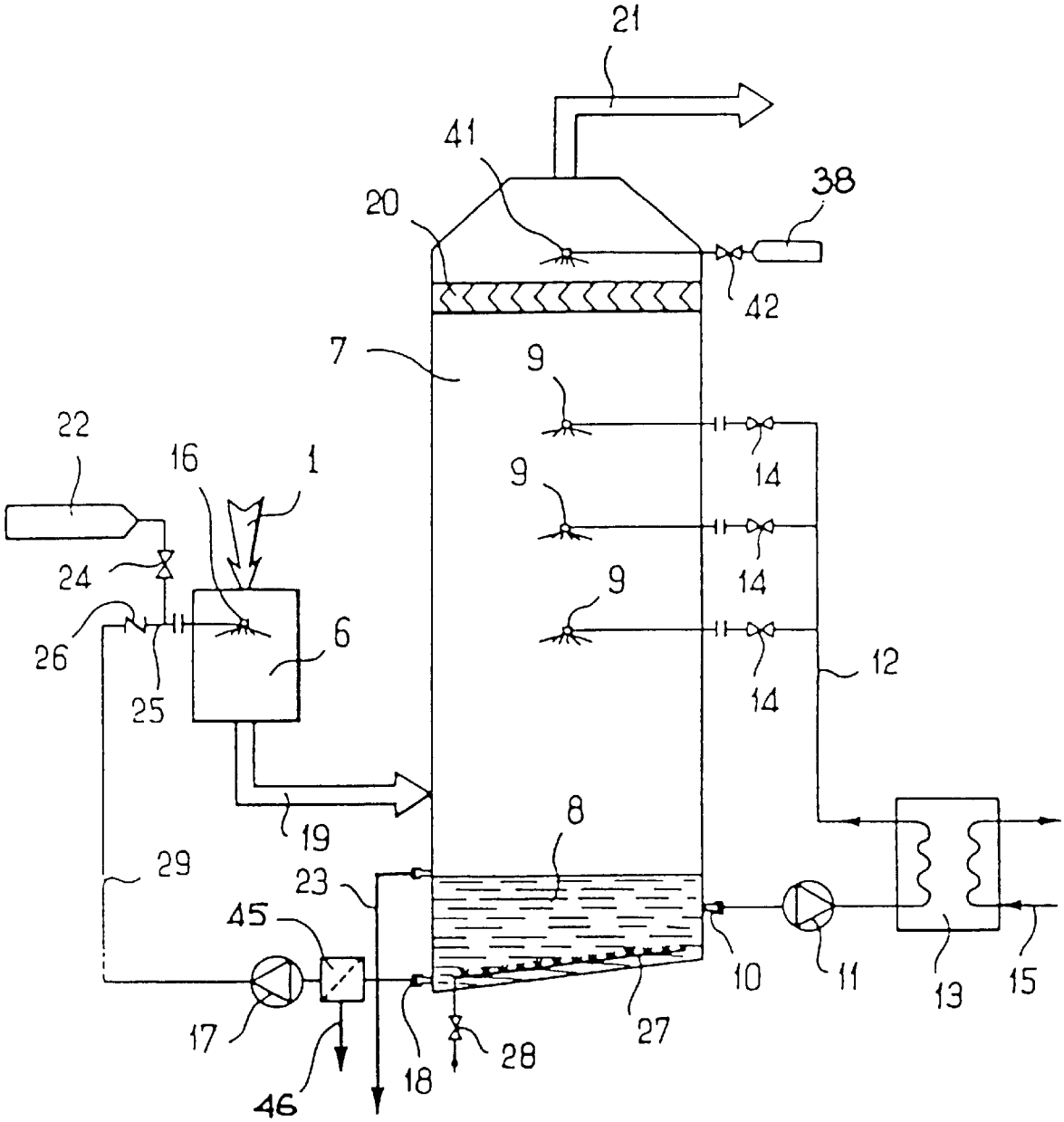
FIG. 3 shows the cooler-condenser of the FIG. 2 embodiment in more detail.

In the FIG. 1 embodiment, the condenser 100 includes a heat exchanger 106 adapted to cool the gases in contact with the surface of the exchanger. As an alternative to this, as shown in FIGS. 2 and 3, it is advantageous to use, especially if the gases to be treated carry a higher concentration of solid particles, a mixing type condenser comprising a spray column 7 in which the gases come into direct contact with a spray of aqueous solution maintained at a temperature below the dew point temperature of the gases, with the result that the heavy metals are extracted from the gases by condensation by mixing, at the same time as the acid pollutants and soluble solid particles contained in the gases are captured.

An aqueous solution 8, initially from the distribution network 38 and maintained at a temperature below the dew point temperature of the gases, is sprayed in the column 7 in the direction opposite to the flow of the gases. To be more precise, the aqueous solution 8 is sprayed by staggered nozzles 9 disposed to form curtains of liquid in the column 7, in the manner that is known in itself. The gases pass successively through the curtains of sprayed aqueous solution and the water vapor that they contain condenses on contact with the fine droplets of the aqueous solution 8, the acid pollutants being absorbed. In this way almost all of the radioactive heavy metals are captured in the acid condensates formed in this way. The elimination of the radioactive heavy metals is facilitated by the acidity of the aqueous solution, due to the dissolution in the latter of the acid gases contained in the gases to be cleaned.

The nozzles 9 are fed by a feed circuit 12 including a pump 11 to take the aqueous solution from the bottom of the column 7 (at 10) and a heat exchanger 13 on the outlet side of the pump 11. Valves 14 in series with the nozzles 9 are used to adjust the flowrate through each nozzle to the required value.

The heat exchanger 13 is adapted to exchange heat between the aqueous solution flowing in the feed circuit 12 and the water in a secondary cooling circuit 15, the temperature of the latter naturally being lower than the required temperature of the aqueous solution to be sprayed. In the manner that is known in itself, the upper part of the column 7 is equipped with a devesiculizer 20 adapted to retain droplets of liquid entrained by the gases leaving the column at 21. This devesiculizer 20 is cleaned, when the head loss on passing through it exceeds a given threshold, by spraying it with water through a nozzle 41 connected by a valve 42 to the distribution network 38.

The cooling enclosure 6 enables the use for the construction of the column 7 of a material having a lower temperature resistance than that required for the enclosure 6, which is exposed to the gases at a higher temperature. This reduces the overall cost of the plant. An aqueous solution is sprayed into the closure 6 through one or more nozzles 16. As shown here, the nozzles 16 are preferably fed by a circuit 29 including a pump 17 for taking the aqueous solution 8 from the column 7 via an offtake 18 at the bottom of the column 7, below the previously mentioned offtake 10, in order to draw off the solid residues accumulating in the bottom of the column 7. A clarifier 45 on the inlet side of the pump 17 recovers these solid residues at 46, from where they are directed into the incinerator 3 to be melted and vitrified. The cooled gases leave the enclosure 6 at 19, with the solution sprayed by the nozzles 16, to enter the column 7 tangentially under the nozzles 9.

For the most part the aqueous solution 8 flows in a closed circuit. However, a purge circuit 23 draws off the solution via an overflow if the concentration in the latter of radioactive heavy metals or other pollutants extracted from the gases is high, with the nozzles 16 receiving a back-up feed from the recycled water supply 22 if necessary. The feed 22 is connected at one end to the distribution network 38 and at the other end, via a valve 24, to a point 25 on the circuit 23 upstream of the nozzles 16 and isolated from the pump 17 by a check valve 26. The purge circuit 23, discharging into the column 7 above the level of the offtakes 10 and 18, enables drawing off of acid pollutants and heavy metals extracted from the gases and, if necessary, hydrocarbons and materials in suspension. The nozzle 41 is fed with recycled water from the supply network 38 to compensate losses of aqueous solution in the column 7, especially if the quantities drawn off are greater than the quantity of water vapor contained in the condensed gases. The sloped bottom of the column is equipped with a manifold 27 fed with low-pressure compressed air via a valve 28 to agitate the aqueous solution 8 before the plant is started up.

The low temperature of the wet gases entering the desulphurization unit 500 advantageously achieves highly efficient desulphurization and an extremely low residual $SO_2$ content, in the order of a few ppm.

Finally, the invention provides an efficient way to eliminate acid pollutants, solid particles and radioactive heavy metals with minimal radioactive solid residues produced by the treatment of the gases. Of course, without departing from the scope of the present invention the cooler-condenser could be fully integrated into the column 7, for example, the first stage of the latter then fulfilling the same role as the cooling enclosure 6. The desulphurization unit could also be integrated into the upper part of the column 7, which would then be equipped with a plate for separating the gases and a basic scrubbing solution. The contraflow spray column 7 could be replaced with a co-flow column.

The plant of the invention advantageously reduces the risk of transfer of pollution by avoiding the production of liquid effluent, thanks to the crystallization unit 36 which recovers water than can be recycled and the heater 300 which eliminates excess water in the form of water vapor into the atmosphere.

The fast cooling of the gases in the cooling enclosure 6 prevents the adsorption of radioactive heavy metals on the solid particles and the formation of organic pollutants such as dioxin and furane.

The plant is also highly efficient at capturing pollutants such as gaseous mercury because of the low temperature at which the gases leave the condenser-cooler, typically in the order of 30° C.

We claim:

1. Method of cleaning gases (1) from an incinerator (3) of lightly radioactive waste, said gases containing water vapor, acid pollutants, solid particles and radioactive heavy metals, the method including a step of cooling the gases and a step of filtering the gases, characterized in that the gases are cooled before filtration or collection of the solid particles, in a cooler-condenser (6, 100; 6, 7) below their dew point temperature to capture the radioactive heavy metals in the condensates at the same time as the acid pollutants and soluble particles contained in the gases, in that the condensates are treated to precipitate the radioactive heavy metals and to recover an aqueous solution that is directed to a crystallization unit (36) in order to recover salts and water, and in that the gases from the cooler-condenser are heated and then directed to an absolute filter (200) adapted to recover the solid particles before the cleaned gases are returned to the atmosphere, the water from said crystallization unit being recycled in the plant.

2. Method according to claim 1 characterized in that the gases (1) are cooled by contact with an aqueous solution sprayed into a cooling enclosure (6) to a temperature near their dew point temperature and then by contact with a condensation heat exchanger (106) to a temperature below their dew point temperature.

3. Method according to claim 1 characterized in that the gases (1) are cooled by contact with an aqueous solution sprayed into a cooling enclosure (6) to a temperature near their dew point temperature and then by direct contact of the gases with an aqueous solution sprayed into a scrubbing column (7) and maintained by a heat exchanger (13) at a temperature below said dew point temperature of the gases, with the result that the heavy metals are extracted from the gases by condensation by mixing at the same time as acid pollutants and soluble particles contained in the gases are captured.

4. Method according to any one of claims 1 to 3 characterized in that, before they are returned to the atmosphere, the cleaned gases (503) are heated by the hot gases directed into the filter (200).

5. Plant (2) for cleaning gases (1) from an incinerator (3) of lightly radioactive waste, said gases containing water vapor, acid pollutants, solid particles and radioactive heavy metals, characterized in that it includes:

a cooler-condenser (6, 100; 6, 7) adapted to cool the gases before filtration or collection of the solid particles to a temperature below their dew point temperature to capture the radioactive heavy metals in the condensates at the same time as acid pollutants and soluble solid particles contained in the gases, a unit (30) for treating the condensates to precipitate the radioactive heavy metals to recover a radioactive precipitate and an aqueous solution, a salt crystallization unit (36) for crystallizing salts contained in said aqueous solution and to recover water to be recycled in the plant (2), a heater (300) for increasing the temperature of the gases on leaving the cooler-condenser, and an absolute filter (200) for recovering solid particles on the outlet side of the heater before the cleaned gases are returned to the atmosphere.

6. Plant (2) according to claim 5 characterized in that the cooler-condenser includes a scrubber column (7) into which the gases are directed and means (11, 12, 14, 9) for drawing off an aqueous solution at the base of the column and reinjecting it, after cooling in a heat exchanger (13), into the column in contact with the gases at a temperature below the dew point temperature of the latter, so that the radioactive heavy metals are extracted from the gases by condensation by mixing at the same time as acid pollutants and soluble particles contained in the gases are captured.

7. Plant (2) according to claim 6 characterized in that it further includes an enclosure (6) for cooling the gases, through which the latter pass before they are directed into the column (7), and means (29) for spraying into said enclosure an aqueous solution drawn off from the bottom of the column (7), and in that the aqueous solution sprayed in this way leaves the cooling enclosure with the gases.

8. Plant according to claim 7 characterized in that the aqueous solution sprayed into said enclosure (6) is drawn off from the bottom of the column (7), at an offtake (18) below the offtake (10) for the aqueous solution (8) sprayed into the column (7), and is passed through a clarifier (45) adapted to remove solid residues contained in the gases.

9. Plant (2) according to any one of claims 5 to 8 characterized in that it includes a heat exchanger (400) adapted to heat the cleaned gases before they are returned to the atmosphere by exchange of heat with the hot gases directed into the filter (200).

10. Plant according to claim 5 wherein said plant includes a desulphurization unit (500) on the outlet side of the filter (200).

* * * * *